United States Patent [19]

Pozzobon

[11] Patent Number: 4,580,358

[45] Date of Patent: Apr. 8, 1986

[54] REAR ENTRANCE SKI BOOT INCORPORATING A FLEX ADJUSTING DEVICE

[75] Inventor: Alessandro Pozzobon, Treviso, Italy

[73] Assignee: Nordica S.p.A., Montebelluna, Italy

[21] Appl. No.: 631,370

[22] Filed: Jul. 16, 1984

[30] Foreign Application Priority Data

Jul. 26, 1983 [IT] Italy ..... 22484/83[U]

[51] Int. Cl.[4] ..... A43B 5/04

[52] U.S. Cl. ..... 36/119

[58] Field of Search ..... 36/117-121, 36/50; 24/685 K, 695 K, 705 K

[56] References Cited

U.S. PATENT DOCUMENTS 4,192,087 3/1980 Salomon ..... 36/119
4,205,467 6/1980 Salomon ..... 36/119
4,449,274 5/1984 Balbinot ..... 36/117 X

FOREIGN PATENT DOCUMENTS 2712001 9/1977 Fed. Rep. of Germany ..... 36/119
3236259 4/1983 Fed. Rep. of Germany ..... 36/119
2539278 7/1984 France ..... 36/117

*Primary Examiner*—James Kee Chi
*Attorney, Agent, or Firm*—Guido Modiano; Albert Josif

[57] ABSTRACT

A rear entrance ski boot incorporating a flex adjusting device, which comprises at least one band element connected to the front quarter of the ski boot and acting by contact on the boot shell. Also provided are means of changing the position of the band element relatively to the front quarter to vary the contact condition between the boot shell and band element itself.

6 Claims, 9 Drawing Figures

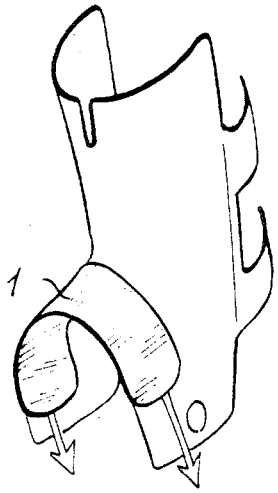
Fig. 2
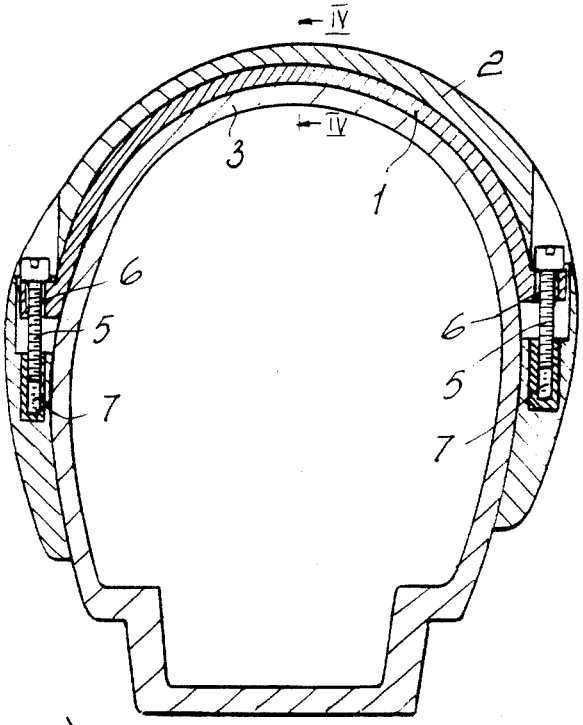
Fig. 3
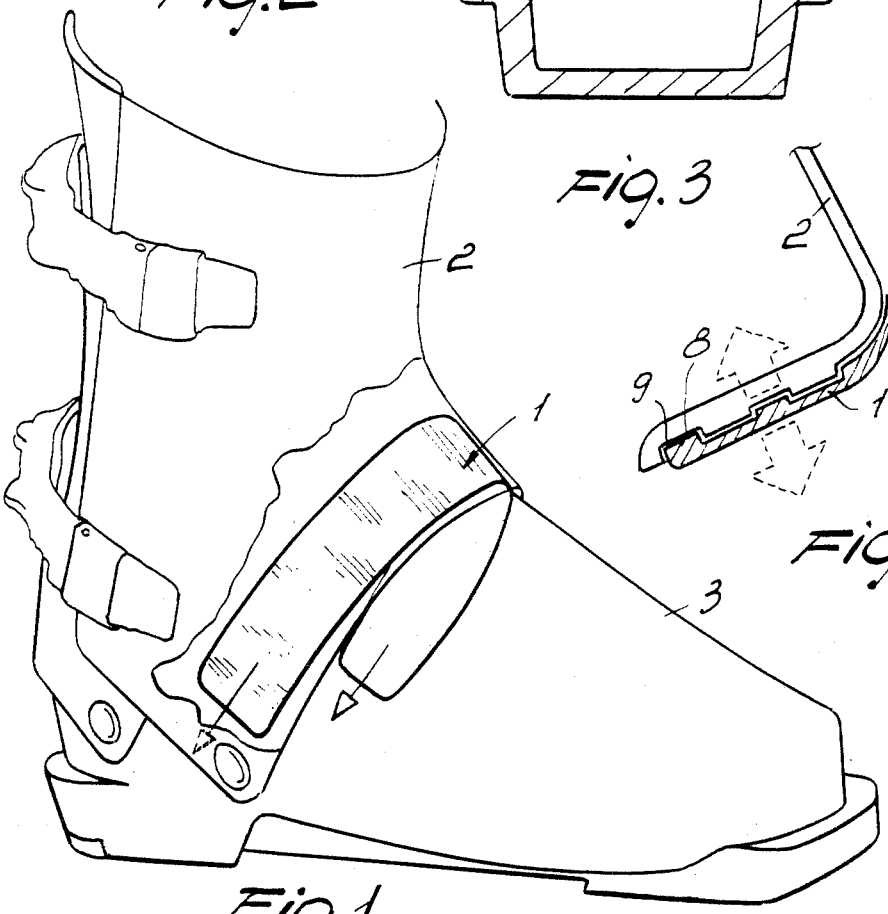
Fig. 1
Fig. 4

REAR ENTRANCE SKI BOOT INCORPORATING A FLEX ADJUSTING DEVICE

BACKGROUND OF THE INVENTION

This invention relates to a rear entrance ski boot incorporating a flex adjusting device.

It is a known fact that a currently much felt problem is that of affording the user with the ability to adjust the boot flex as desired, i.e. of adjusting at will the resistance opposed by the boot to the forward leaning movement of the boot front quarter.

Presently used devices are based upon a variety of designs but share one adverse feature, i.e. that of having in general a complex construction and involving difficult-to-perform operations to effect a desired adjustment.

Another disadvantage of prior devices is that they do not permit the amount of flex to be adjusted continuously, the adjustment being generally effected in steps which may even differ relatively to one another.

SUMMARY OF THE INVENTION

It is a primary object of this invention to provide a device for flex adjustment particularly in rear entrance ski boots, which is constructionally simple and structured to involve no substantial modifications of the boot structure, while being barely visible from the outside so as not to mar the traditional design of the boot.

A further object of the invention is to provide such a device which can make, according to necessity, the geometric rotation between the front quarter and shell more or less easily performed through a quick and easy to apply means.

It is another object of this invention to provide such a device which can be easily formed from commercially available elements, and is advantageous from the purely economical standpoint.

These and other objects, such as will be apparent hereinafter, are achieved by a rear entrance ski boot incorporating a flex adjusting device, according to the invention, characterized in that it comprises at least one band element connected to the front quarter of the ski boot and acting by contact on the boot shell, means being provided to vary the position of said at least one band element relatively to said front quarter, thereby changing the contact condition between said boot shell and band element.

BRIEF DESCRIPTION OF THE DRAWINGS

Further features and advantages will be more readily apparent from the following detailed description of a rear entrance ski boot incorporating a flex adjusting device, as illustrated by way of example only in the accompanying drawings, where:

FIG. 1 shows schematically a ski boot with the device of this invention using a cross band;

FIG. 2 shows schematically the front quarter with the cross band applied;

FIG. 3 is a sectional view through the ski boot taken on a perpendicular plane to the shell longitudinal direction;

FIG. 4 is a sectional view taken along the line IV—IV of FIG. 3;

DESCRIPTION OF THE PREFERRED EMBODIMENTS

Figure 6:
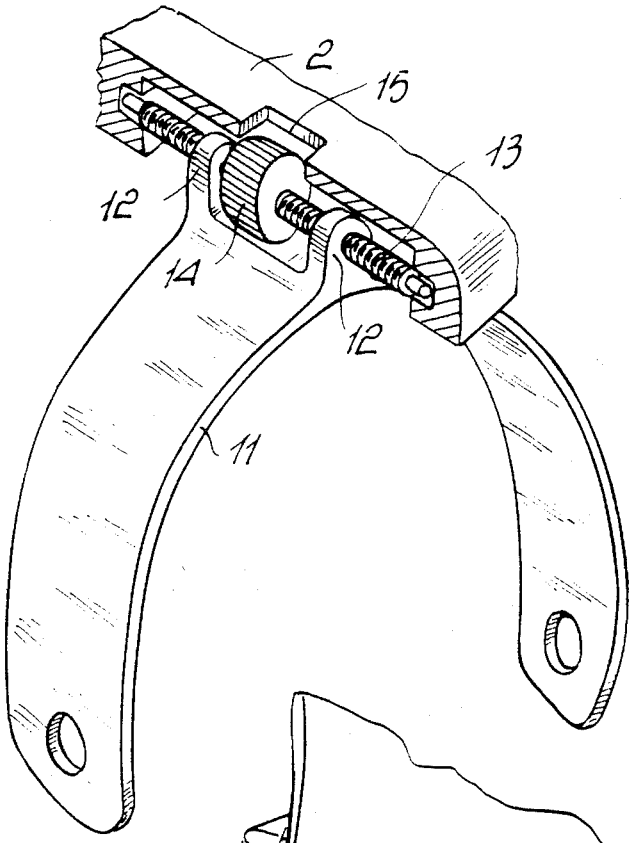
FIG. 6 shows schematically a partly cut-away perspective view of the oscillating band.

Making reference to the drawing views and in particular to FIGS. 1 to 4, this ski boot incorporating a flex adjusting device comprises a cross band element, generally designated with the reference numeral 1, which is associated with the bottom face of the front quarter at forward portion of the quarter overlapping the instep covering portion 3 of the boot shell with an overlapping surface portion thereof.

The band 1 extends crosswise to the user's foot main direction, essentially at the foot instep.

The cross band 1 is supported at its end on the quarter, being secured thererto by screw fastener means 5 engaging in end eyes 6 provided at the band end and being connected to threaded seats 7 defined on the quarter.

Provided on the face of the band 1 facing toward the overlapping surface portion of the front quarter are ribs 8 which engage in corresponding seats 9 provided in said overlapping portion to join together the cross band 1 and front quarter 2.

With its bottom face, i.e. the remote one from that having the ribs 8, the band 1 acts by contact against the instep covering portion 3 of the boot shell.

By operating the screws 5, the cross band 1, which is supported on the front quarter 2, is practically pressed to a greater or lesser extent against the shell 3 so as to change the characteristics of the contact area to make rotation of the quarter 2 relatively to the shell 3 more or less easily performed, thereby adjusting the amount of flex.

It may be appreciated that by applying a pull to the cross band 1, i.e. by tightening the screws 6, the cross band 1 is pressed with increased force against the shell 3, thereby increasing the frictional coefficient which resists the mutual rotation of the quarter 2 and shell 3.

By loosening the screws, the pull force on the cross band 1 is, of course, decreased, and accordingly, the oscillatation of the quarter with respect to the shell favored.

Figure 5:
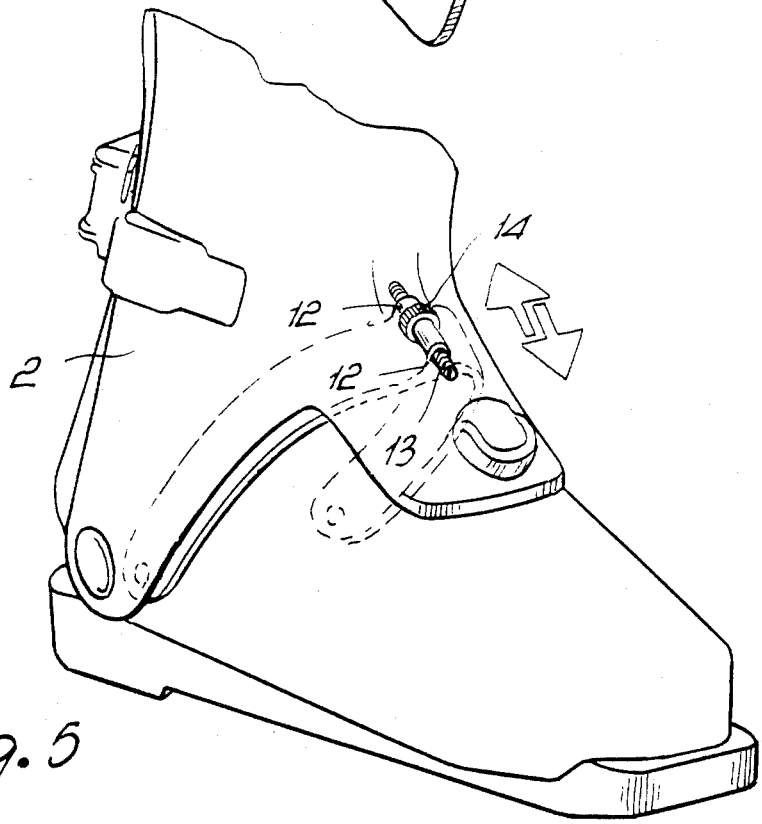
FIG. 5 shows a ski boot with the device of this invention having an oscillating band.

As shown in FIGS. 5 and 6, an oscillating band 11 is provided overriding the instep portion 3 of the boot shell and which is hingedly connected with its ends to the side portion of the front quarter, again indicated at 2.

The oscillating band 11 is provided, at its upper portion, with a pair of ears 12 which engage with a threaded bar 13 journalled at its ends on the lower portion, i.e. the portion concealed from view of the front quarter 2.

A ring nut 14, which can be reached through a small window 15 through the outside of the quarter 2, engages with the threaded bar 13 at the area included between the ears 12, thereby manipulating the ring nut 14, the bar 13 can be rotated to produce a translation of the ears 12 relatively to the bar 13, which is converted into an oscillatory or pivotal movement of the oscillating band 11 about its hinge connection points on the front quarter 2.

The oscillation of the oscillating band 11 brings about either an increase or decrease of the contact areas between the oscillating band 11 and shell, and consequently a change in the frictional force developed between the band and shell, thereby the effort required to effect the swinging movement between the quarter and shell.

Figure 7:
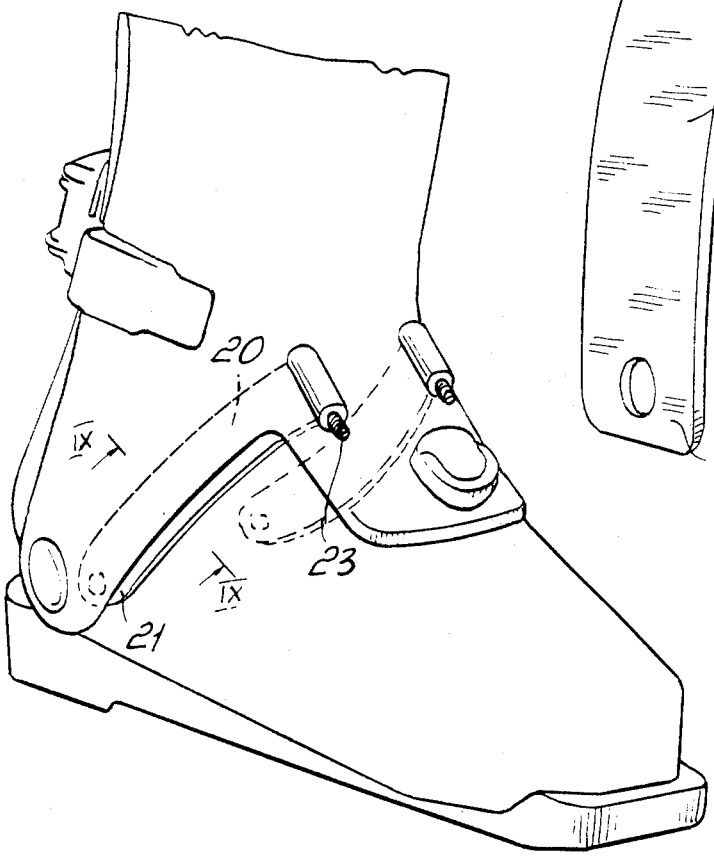
FIG. 7 shows a boot with the device of this invention comprising two side bands.
Figure 8:
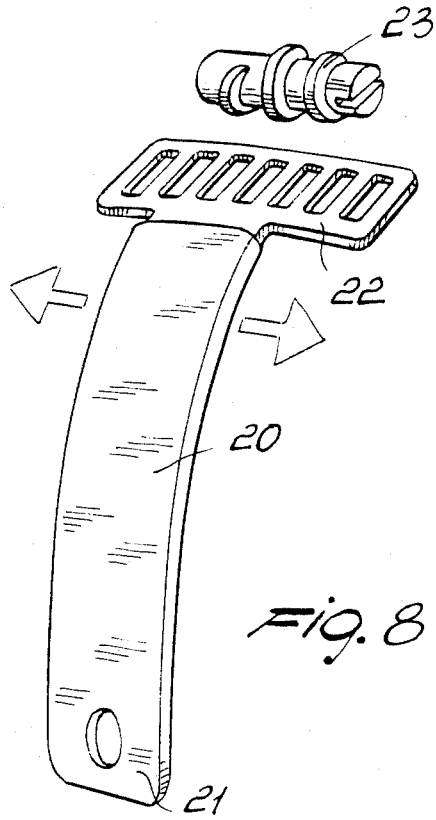
FIG. 8 is a perspective view of the side band.
Figure 9:
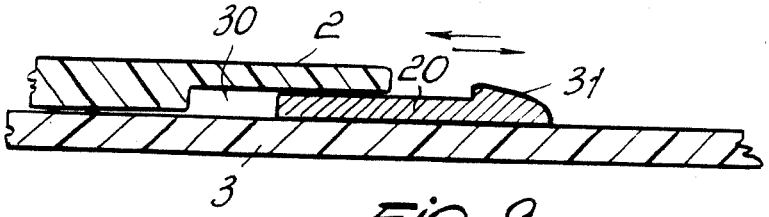
FIG. 9 is a sectional view taken along the line IX—IX of FIG. 7.

Shown in FIGS. 7 to 9 is a device which comprises a pair of side bands 20 associated at the bottom face, i.e. the face of the front 2 which is concealed from view and again indicated at 2, which side bands 20 have one of their ends, indicated at 21, hingedly connected to the front quarter 2, at side regions thereof.

Each band 20 has, at its other end, a means adapted to generate the rotation of the band 20 with respect to the end 21. In a preferred embodiment, such means includes a plate or strip 22 with parallel slots, which engages with a worm screw 23 carried rotatably on the quarter, thereby the rotation of the worm screw 23 results in a translation of the slotted strip and consequent oscillation of each side band relatively to the front quarter, with attendant variation of the contact area between said side band 20 and the shell 3.

As shown in FIG. 9, the band 20 is positioned in a recess 30 defined by the bottom face of the front quarter 2, and has on the front a stopper projection indicated at 31.

Also in this case, by causing the side bands to swing on their ends journalled to the front quarter, the contact area between the side bands and shell can be varied, and hence, the friction conditions can be changed which affect the flexing of the front quarter relatively to the shell.

It may be appreciated from the foregoing that the invention achieves its objects, and in particular the fact should be enhanced that a device is provided which allows the contact conditions between one part rigid with the front quarter and the boot shell to be varied, thereby increasing or decreasing the mutual frictional coefficient and varying, as a result, the boot amount of flex.

In practicing the invention, the materials used, while best results are to be obtained through the use of plastic materials, as well as the dimensions and contingent shapes, may be any selected ones to meet individual requirements.

I claim:

1. In a ski boot including a boot shell with an instep covering portion and a front quarter hingedly connected to said boot shell for allowing limited oscillating movement of said quarter with respect to said shell, said front quarter having a forward portion overlapping partially said instep covering portion, a flex adjusting device comprising, between said forward portion and said instep covering portion, at least one band element and adjusting means for changing contact conditions between said boot shell and said band element.

2. A device according to claim 1, wherein said band element extends crosswise and has eye formations at opposite ends thereof and wherein said adjusting means comprise screws in engagement with said eye formations and with said forward portion.

3. A device according to claim 1, wherein said band element extends crosswise and has eye formations at opposite ends thereof and wherein said adjusting means comprise screws in engagement with said eye formations and with said forward portion, said band element having a surface with rib formations thereon and said forward portion having an overlapping surface with seat formations thereon for matingly receiving said rib formations therein.

4. A device according to claim 1, wherein said band element is arranged to override said instep covering portion of said shell and has hinge means allowing limited oscillation movement of said band relative to said instep covering portion and said forward portion and wherein said adjusting means comprise ears arranged on said band element, a threaded bar journalled on said forward portion, a ring nut on said threaded bar in engagement therewith and positioned between said ears, at least a portion of said ring nut facing outwards to allow free access thereto, thereby an adjusting rotation of said ring nut producing a translation of said ears along said bar with consequent adjusting angular movement of said band element for changing the contact conditions between said band element and said boot shell.

5. A device according to claim 1, comprising a pair of said band elements each hinged with one end thereof between said forward portion of said quarter and said instep covering portion of said shell and wherein said adjusting means comprise said adjusting means arranged at another end of each of said bands, opposite to said one end thereof to produce adjusting angular movement of said band elements for changing the contact conditions between said band elements and said boot shell.

6. A device according to claim 5, wherein said adjusting means comprise a worm screw carried rotatably on said forward portion and a slotted strip connected to said another end of said band elements.

* * * * *